US007543717B2

(12) United States Patent
Hinkle

(10) Patent No.: US 7,543,717 B2
(45) Date of Patent: Jun. 9, 2009

(54) BOUQUET ENHANCING WINEGLASS

(76) Inventor: Allen J. Hinkle, 65 Jenkins Rd., Lebanon, NH (US) 03766

( * ) Notice: Subject to any disclaimer, the term of this patent is extended or adjusted under 35 U.S.C. 154(b) by 908 days.

(21) Appl. No.: 10/919,067

(22) Filed: Aug. 16, 2004

(65) Prior Publication Data

US 2006/0032855 A1 Feb. 16, 2006

(51) Int. Cl.
*B65D 25/02* (2006.01)

(52) U.S. Cl. ..... 220/508; 220/703

(58) Field of Classification Search ..... None
See application file for complete search history.

(56) References Cited

U.S. PATENT DOCUMENTS

| | | | | | |
|---|---|---|---|---|---|
| 395,303 | A | | 12/1888 | Wuchner | |
| 1,060,419 | A | | 4/1913 | Benjamin | |
| 1,134,354 | A | | 4/1915 | Seifke | |
| 2,187,558 | A | | 1/1940 | Kushima | |
| 2,208,431 | A | | 7/1940 | Rochow | |
| 2,965,274 | A | | 12/1960 | Brillis et al. | |
| 3,028,035 | A | | 4/1962 | Leong | |
| 4,555,040 | A | * | 11/1985 | Butenschon | 215/365 |
| 4,930,652 | A | * | 6/1990 | Murphy et al. | 220/706 |
| 4,993,566 | A | * | 2/1991 | Eberle | 215/373 |
| D343,990 | S | | 2/1994 | Maraan, II | |
| D363,854 | S | | 11/1995 | Katz | |
| D388,660 | S | * | 1/1998 | Grundl | D7/507 |
| D405,316 | S | | 2/1999 | Spike | |
| 6,409,374 | B1 | | 6/2002 | Willat | |
| 6,502,712 | B1 | | 1/2003 | Weber-Unger | |
| 6,644,846 | B2 | | 11/2003 | Willat | |
| 6,758,058 | B1 | | 7/2004 | Citrynell et al. | |
| 2003/0189055 | A1 | | 10/2003 | Thinnes | |
| 2005/0135186 | A1 | | 6/2005 | Mbakop | |

FOREIGN PATENT DOCUMENTS

| | | |
|---|---|---|
| DE | 197 57 413 A 1 | 7/1999 |
| FR | 825905 | 3/1938 |
| FR | 1435764 | 3/1966 |

* cited by examiner

*Primary Examiner*—Stephen Castellano
(74) *Attorney, Agent, or Firm*—Michael J. Weins; Jeffrey E. Semprebon

(57) ABSTRACT

A wineglass having a bowl of depth D and a bottom region symmetrically disposed about a central axis is provided with a protrusion having a central core, attaching to the bottom region of the bowl and terminating in a central core free end, and one or more ledges attached to the central core and positioned to form one or more wine-supporting ledge surfaces positioned intermediate between the central core free end and the bottom region of the bowl. The protrusion is disposed about the central axis and has a height H that is preferably between about 0.5 D<H<0.8 D. When the wineglass is swirled, the wine-supporting ledge surfaces serve to catch the wine and allow the wine to subsequently fall back, thus aerating the wine and enhancing the perceived bouquet. The protrusion can include a pedestal sized to aid in measuring a sample volume of wine.

9 Claims, 6 Drawing Sheets

BOUQUET ENHANCING WINEGLASS

BACKGROUND OF THE INVENTION

Numerous wine glasses have been developed for the drinking and tasting of wine. Some of these glasses are designed to enhance the bouquet of the wine. Riedel has developed wine glasses where the bowl is shaped to match a particular type of wine, as discussed in the Background of U.S. Publication No. 2003/0189055. Riedel, in German patent document DE 197 57 413 A 1, has also developed a wine tasting glass with a hollow stem for tasting wine; the hollow stem is provided to allow a small controlled volume to be provided to the taster.

Beverage containers have been made having protrusions in a central portion, frequently for artistic or visual effect, such as taught in U.S. Pat. Nos. 3,028,035; Des. 405,316; Des. 363,854; and Des. 343,990. Protrusions have also been used to improve the mixing action of shakers for preparing mixed drinks, as taught in U.S. Pat. No. 2,208,431. More recently, protrusions have been employed in wine tasting vessels to increase the release of the bouquet of a wine as a sample of wine in the vessel is swirled, as taught in U.S. Pat. Nos. 6,644,846 and 6,409,374. These patents teach a protrusion having a platform which extends across the top of the protrusion and is described as extending to and continuing down the side, forming what might be viewed as a vertical rib or fin protruding from the protrusion. This protrusion is employed in combination with a rib on the interior surface of the vessel positioned opposite the platform, to constrict the flow of the swirled liquid in order to provide a venturi effect to promote release of the bouquet. This geometry would appear to provide most of the disturbance beneath the surface and, unless the swirling were very violent, would not notably aerate the wine, thereby limiting the effectiveness in enhancing the bouquet. Furthermore, the rib is an integral part of the sidewall of the glass and thus interferes with the visual observation of the clarity and color to the wine which contributes to the tasting experience.

Thus, there is a need for a wineglass which is effective in enhancing the bouquet of the wine contained therein while providing an aesthetically pleasing appearance.

SUMMARY OF THE INVENTION

The present invention is for a wineglass which has a bowl with a depth D and a bottom region symmetrically disposed about a central axis of the bowl. The bowl is preferably supported by a stem terminating in a base.

The improvement of the present invention enhances the bouquet sensed by a taster by providing a protrusion in the bowl and attached to the bottom region of the bowl. The protrusion has a central core, which attaches to the bottom region of the bowl and terminates in a central core free end residing in the bowl of the glass, and has a protrusion height H. The central core extends along the central axis and the protrusion is disposed about the central axis. The protrusion is provided with one or more ledges attached to the central core and positioned such that a portion of least one of the one or more ledges forms a wine-supporting ledge surface that is positioned intermediate between the central core free end and the bottom region of the glass. These one or more wine-supporting ledge surfaces serve to catch the wine when the glass is swirled and to allow the wine to subsequently fall back, thus aerating the wine and enhancing the bouquet experienced by the taster.

It is preferred to maintain the protrusion height H between about $0.5\ D<H<0.8\ D$ to allow a sample of wine to be poured into the bowl and still leave a substantial portion of the protrusion above the wine level so that, upon swirling, the wine can be washed up onto the one or more ledges. The protrusion can include a pedestal so sized that, when the glass is filled to the top of the pedestal, there will be a set volume contained in the glass which is a small fraction of the volume of a bottle of wine. This allows a bottle of wine to be evenly distributed over a fixed number of glasses.

It is also preferred for the protrusion to be configured such that the radial extension of the one or more ledges from the central axis, which may be visualized as defining a protrusion envelope, generally decreases as the elevation from the bottom region of the bowl increases. This envelope is preferably adjusted to suit the bouquets of particular types of wines. For example, for full bodied red wines, a small decrease in the radial extension or a steep walled envelope may be most suitable, since the strong bouquet requires only slight enhancement. In contrast, a larger decrease in the radial extension or a shallow walled envelope may be best suited for light white wines, to provide a more intense enhancement of the light bouquet of such wines.

In addition to adjusting the profile of the protrusion envelope, the shape of the bowl may also be adjusted to suit a particular type of wine. For example, narrower and deeper glasses (steep walled glasses) are used for white wines and wider, shallow glasses (shallow wall glasses) are used for red wines. In general, the steepness of the protrusion envelope chosen will tend to be inversely related to the wall steepness of the glass.

When the wineglass does not have a stem, further adjustment both the shape and the thickness of the glass to suit a particular type of wine may include the use of thicker glass near the bottom region of the bowl for use with chilled wines to prevent undue warming. Further details of such glass configuration are taught in U.S. Publication No. 2003/0189055.

In a preferred embodiment, where there are multiple ledges which are arranged to create a stepped vertical profile, it is further preferred for the ledges to have a wine-supporting ledge surface which is substantially planar; however, the surface can be convex or concave when viewed from above to modify the wine retaining characteristics of the ledge. The flat or concave ledge surface will provide a greater wine catching capacity, which in turn should provide more wine for overflowing these ledge surfaces and result in greater cascading action when the wine tumbles down the stepped profile.

It is further preferred that the one or more ledges be connected to form one or more spiral ramps with a sufficient slope such that, as the wine is swirled, it will be washed up the ramp and then overflow, thereby aerating the wine to enhance its bouquet.

In one preferred embodiment employing spiral ramps, the one or more spiral ramps each have a peripheral edge generally decreasing in radius from the central axis as the one or more ramps rise above the bottom region of the glass.

When a single spiral ramp is employed, enhancing the efficiency of the swirling action can be accomplished by providing a step configuration where the wine-supporting ledge surface of the spiral ramp serves as the tread of the step, and the peripheral edge of the spiral ramp is joined by a downward-directed riser of depth d which connects the peripheral edge to an internal edge of the ramp that resides below. This will promote splashing of the wine up onto the ramp above, thereby providing greater overflow and better aeration.

Another preferred geometry for embodiments using a single spiral ramp is to have a width W that decreases as the height from the bottom region of the glass increases. This may increase the overflowing action of the wine on the ramp when the wine is swirled. It is also preferred that the depth d between levels of the ramp decrease with height, since the volume on the ramp will decrease. One preferred configuration is to have both W and d decrease in approximately an exponential manner as a function of the distance up the ramp.

When the ledges are connected so as to provide multiple ramps, the ramps are arranged so that they are intertwined in a non-intersecting manner. One preferred embodiment for such an array of interpenetrating ramps is formed by ledges provided by four twisted sail-shaped ramps attached to a central mast which serves as the central core.

DESCRIPTION OF THE PREFERRED EMBODIMENTS OF THE INVENTION

Figure 1:
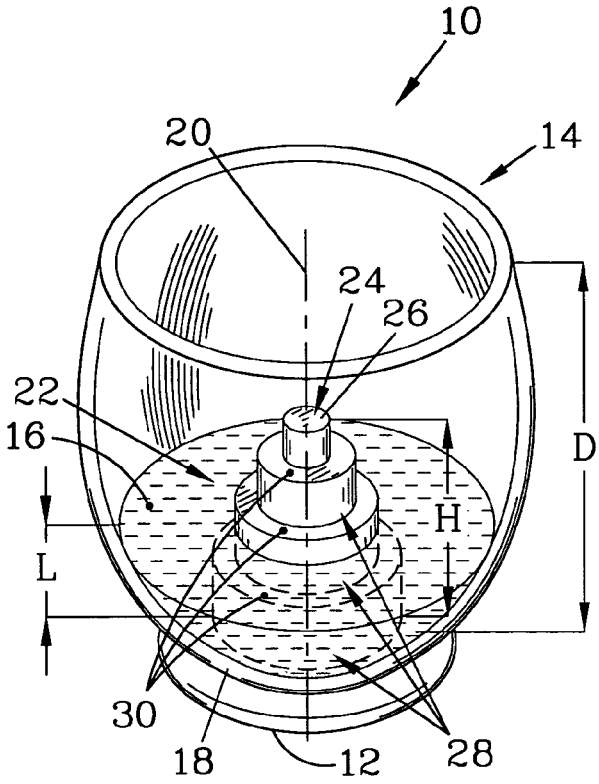
FIG. 1 illustrates a stemless wine glass of the present invention having a protrusion disposed about a central axis of the glass. The protrusion is formed by a stack of concentric disks axially aligned on the central axis. Each successive disk attaches an upper surface of the disk below. The upper surfaces of the intermediate disks provide ledges having planar wine-supporting ledge surfaces. A central core is provided by the upper disk in combination with the region of the remaining disks residing therebelow. The lower disk, when appropriately sized, can serve as a pedestal for metering a sample of wine.

FIG. 1 is a isometric view of a wineglass 10 which forms one embodiment of the present invention. The wineglass 10 is a stemless glass having a flat bottom 12, and has a benefit in that it has a lower center of gravity than a conventional stemmed wineglass. The wineglass 10 has a bowl 14, which serves to hold a quantity of wine 16 and has a depth D. The bowl 14 has a bottom region 18 which is symmetrically disposed about a central axis 20. If the wine glass 10 is to be used to sample white wine, then it is preferred that the bottom region 18 be thicker to reduce the heating caused by a hand gripping the glass. For sampling of the wine 16, the bowl 14 is only filled with the wine 16 to a level L. Typically, this level is less than about ½ inch (13 mm). When sampling the wine 16, the taster mildly agitates the wine 16 by swirling the wineglass 10 to enhance the bouquet of the wine 16 before it is sampled.

The agitation is accomplished by swirling the wineglass 10 roughly in a plane normal to the central axis 20 and imparting an essentially circular motion of the axis 20. This motion results in the wine 16 being carried up the sides of the bowl 14. When the swirling is stopped, the wine 16 settles back. This motion of the surface of the wine 16 relative to the air captive in the bowl 14 enhances transfer of the bouquet of the wine 16 to the air, which in turn increases the flavor perceived by the taster upon tasting the wine 16.

While some enhancement of the bouquet by swirling as discussed above can be achieved by a conventional wineglass, the improved wineglass 10 has additional structural elements which further enhance the bouquet presented to the taster sampling the wine. The wineglass 10 has a protrusion 22 which has a central core 24 which attaches to the bottom region 18 of the bowl 14 and extends up into the bowl 14 from the bottom region 18. The central core 24 terminates in a core free end 26 residing in the bowl 14. The protrusion 22 is disposed such that the central axis 20 passes through the central core 24. The protrusion 22 has a height H sufficiently large as to assure that the protrusion 22 extends partly above the wine level L.

In this embodiment, the protrusion 22 is formed by a series of stacked cylindrical disks 28 which include segments of the central core 24. The stacked cylindrical disks 28 are each symmetrically disposed about the central axis 20, resulting in ledges 30 which are symmetrically disposed with respect to each other and the central axis 20 and which are positioned intermediate between the core free end 26 and the bottom region 18 of the bowl 14.

The protrusion 22 serves to further enhance the release of the bouquet to the air captive in the wineglass 10 by providing the ledges 30, which serve as wine-supporting ledge surfaces onto which the wine 16 will wash up as the wine 16 is swirled, and thereafter will cascade down as the ledges 30 overflow, thereby aerating the wine 16 so as to further transfer the bouquet to the captive air.

Preferably, the height H is set such that $0.5\ D<H<0.8\ D$. Maintaining such a ratio allows a generous sample of wine 16 to be poured into the bowl 14 while still maintaining at least about 1 inch (25 mm) of the protrusion 22 above wine level L.

Figure 2:
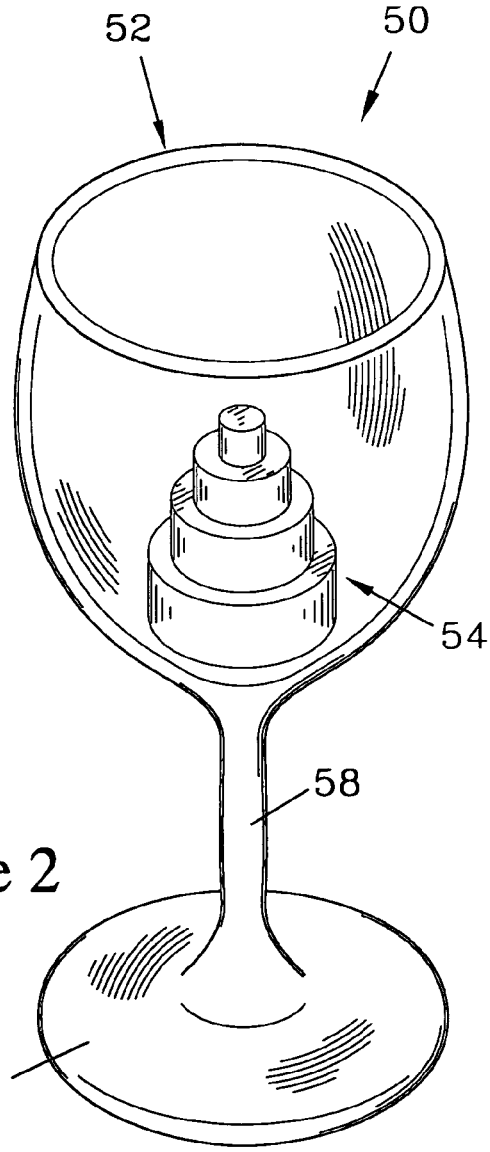
FIG. 2 illustrates a wineglass similar to the wineglass of FIG. 1; however, this wineglass includes a stem and a stem base on which the wineglass rests. The stem provides several benefits to the glass. For white wines, which are typically chilled, the stem reduces warming of the wine from the heat of the hand. For all wines, the stem also places the fingers of a taster at a greater distance from the wine so that, if food has been handled by the taster, the bouquet of the wine will be less likely to be compromised by the food aroma. Also, the stem allows the taster to readily impart a spin component to compliment the swirling motion of the wine held in the glass. Again, if appropriately sized, the lower disk can serve as a pedestal for metering a wine sample volume of wine.

FIG. 2 is an isometric illustration of a wineglass 50 which is similar in many respects to the wineglass 10. The wineglass 50 has a bowl 52 for holding wine as well as a protrusion 54 residing in the bowl 52. The wineglass 50, rather than having a flat bottom 12 for resting the glass, has a wineglass base 56 which is connected to the bowl 52 by a stem 58. The stem 58 eliminates the necessity of touching the bowl 52 to grasp the wineglass 50, and thus allows the taster to avoid warming the wine as the wineglass 50 is held. Grasping the stem 58 also places the hand at a further distance from the bowl 52 so that, in the event that the taster has handled material such as food having a scent, the effect of remnants of this scent on the perception of the wine's bouquet will be substantially reduced.

Figure 3:
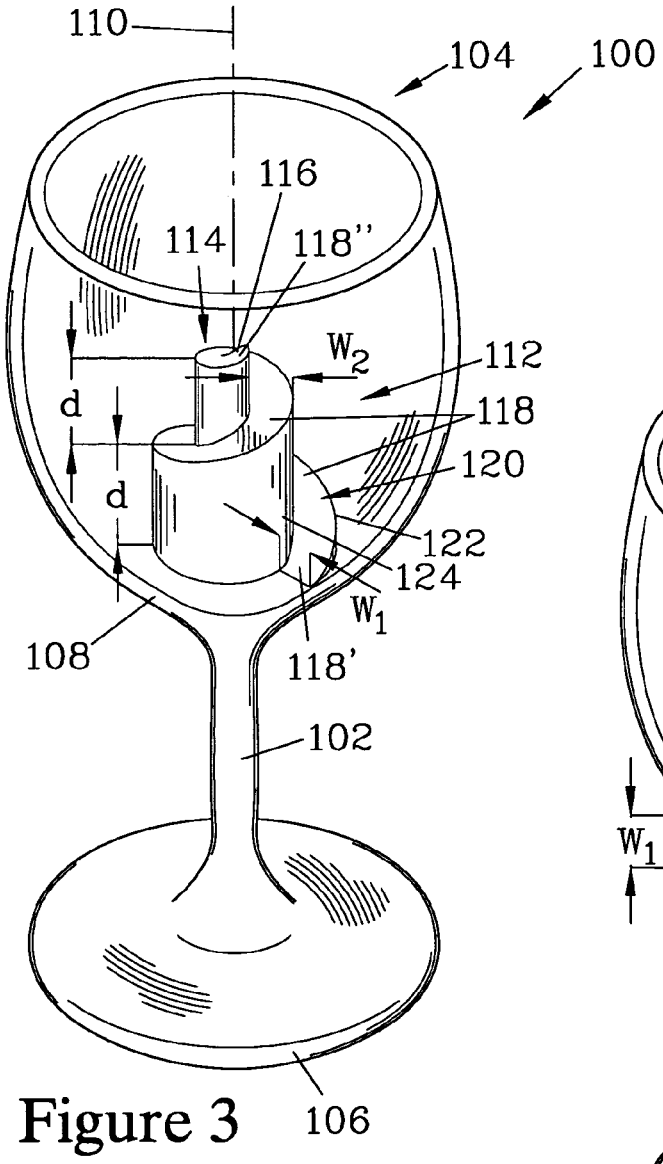
FIG. 3 illustrates a wineglass having a protrusion with ledges of width W that are joined to form a single spiraling ramp. In this embodiment, both the pitch and the width of the single spiral are constant. The profile of the protrusion is a stepped profile. The ramp has a wine-supporting ledge surface that forms the tread of a step and a riser of depth d joins the tread segment to the segment below to form a backed step.

FIG. 3 is an isometric illustration of a wineglass 100 that forms another embodiment of the present invention. This wineglass 100 also has a stem 102 attached to a bowl 104 and to a base 106. The bowl 104 has a bottom region 108 which is symmetrically disposed about a wineglass central axis 110. This embodiment is also provided with a protrusion 112 having a central core 114 which attaches to the bottom region 108 of the bowl 104 and terminates in a core free end 116 which rises above the bottom region 108.

The protrusion 112 of this embodiment has ledge segments 118 attached to the central core 114 and disposed about the central axis 110. The ledge segments 118 are sloped so that they connect to form a single spiral ramp 120 which provides a wine-supporting ledge surface. In this embodiment, the lowest ledge segment 118' connects to the bottom region 108 while the uppermost ledge segment 118" terminates in the core free end 116. The single spiral ramp 120 is configured so as to have substantially uniform width, such that $W_1$ is substantially equal to $W_2$.

Having the spiral ramp 120 rather than a series of discrete ledges provides greater flexibility in the motion that can be used to enhance the bouquet of the wine. A spinning action about the central axis 110 will cause flow up the single spiral ramp 120 and down the spiral ramp 120 when the rotation is reversed. When the wineglass 100 is spun one direction, the flow tends to pump the wine up the spiral ramp 120, where it then overflows and creates a cascading effect. This effect can be used in addition to the swirling action discussed above with regard to the protrusions (22, 53) shown in FIGS. 1 and 2, and the benefits from swirling and spinning should be cumulative providing the spinning is in a direction to advance the wine up the spiral ramp 120, which provides the wine-supporting ledge surface.

The protrusion 112 has the spiral ramp 120 configured so as to serve as a tread of a step which has a width W extending between a peripheral edge 122 and a riser 124. The riser 124 has a riser depth d and is provided by a substantially vertical wall that drops down from the peripheral edge 122 to terminate at the next wrap down of the spiral ramp 120. This configuration brings benefits over the protrusion of FIGS. 1 and 2 in that, in addition to the splash up over the riser 124, there will also be a running up the spiral ramp 120 as well as a component from the spin if the spin is in a reinforcing direction.

The spiral ramp 120 illustrated is a levorotatory spiral; that is, it curves toward the left as its height above the bottom region 108 increases. This configuration is well suited for swirling by a right-handed user, since it has been found that a levorotatory swirling action, appearing counterclockwise from above, is the preferred direction of rotation for the right hand. When the wineglass 100 is rotated to the left, this action will tend to force wine up the spiral ramp 120. It should be appreciated that, to make a wineglass better suited for left-handed users, a protrusion having a dextrorotatory spiral ramp could be employed, where the spiral ramp curves to the right as its height increases. It should also be appreciated that, while the spiral ramp 120 illustrated is formed by continuously curved surfaces, a spiral ramp could be employed which has stepped or faceted surfaces, rather than continuously curved surfaces. Such steps or facets may serve to enhance the agitation and aeration of the wine; however, such structures may be difficult to fabricate.

Figure 4:
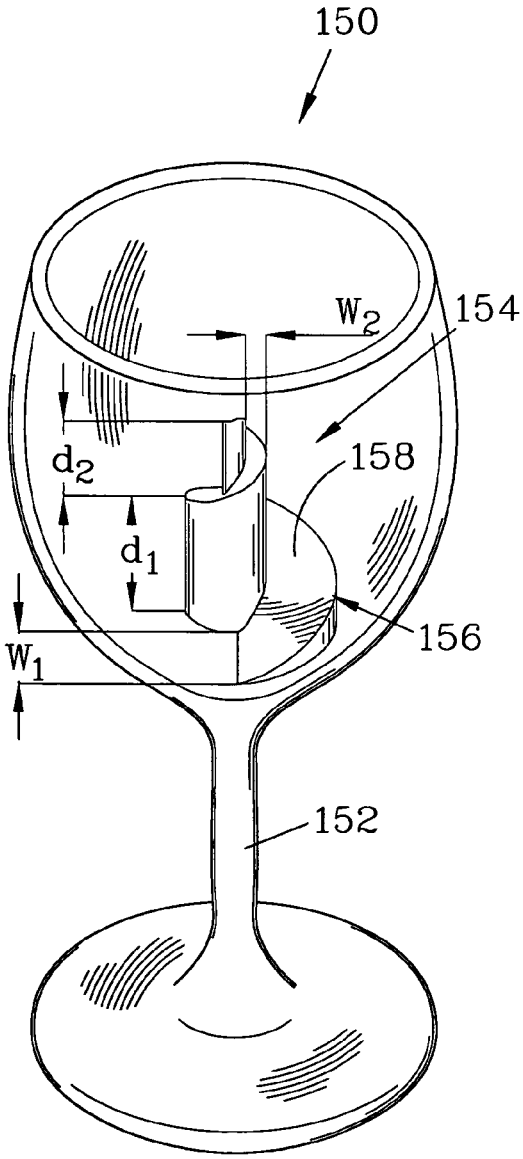
FIG. 4 illustrates a wineglass having ledges connected as in the embodiment illustrated in FIG. 3; however, the width W of the ledge and the riser depth d of the spiral decrease as the elevation of the ramp increases.

FIG. 4 is an isometric view of a wineglass 150 with a stem 152 which forms another embodiment of the present invention. The wineglass 150 differs from the wineglass 100 in the details of the character of a protrusion 154 and, in particular, of a ramp 156 and its wine-supporting ledge surface 158. In this embodiment, the wine-supporting ledge surface 158 has a decreasing width as its elevation increases, such that $W_1$ is greater than $W_2$. The pitch of the wine-supporting ledge surface 158 is also continuously decreasing, such that the vertical separation between revolutions $d_1$ is greater than $d_2$. It is further preferred that both the width W and the vertical separation d vary in an exponential fashion.

Figure 5:
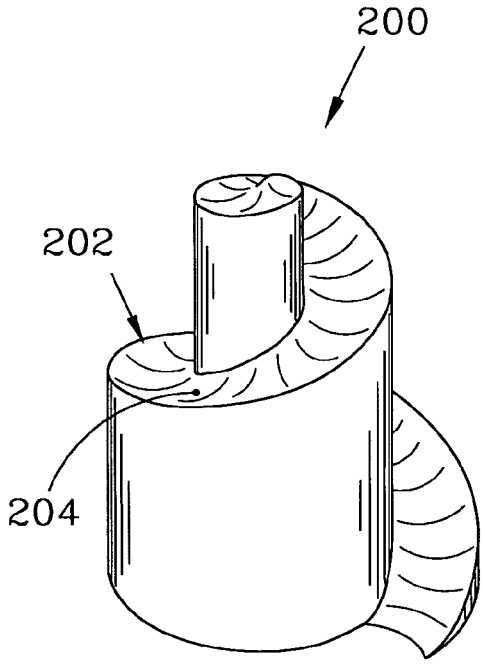
FIG. 5 illustrates a protrusion for a wineglass similar to the protrusion shown in FIG. 3, but where the spiral ramp has a concave wine-supporting ledge surface when viewed from above.

FIG. 5 is an isometric view of a protrusion 200 which can be substituted for the protrusion 112 of the embodiment illustrated in FIG. 3 or for the protrusion 154 of the embodiment illustrated in FIG. 4. In this embodiment, the protrusion 200 has a spiral ramp 202 having a wine-supporting ledge surface 204 that is concave when viewed from above. This configuration should increase the height to which the wine can be raised on the ramp 202, and thus is felt would increase the drop and the cascade effect, thereby further enhancing the bouquet.

Figure 6:
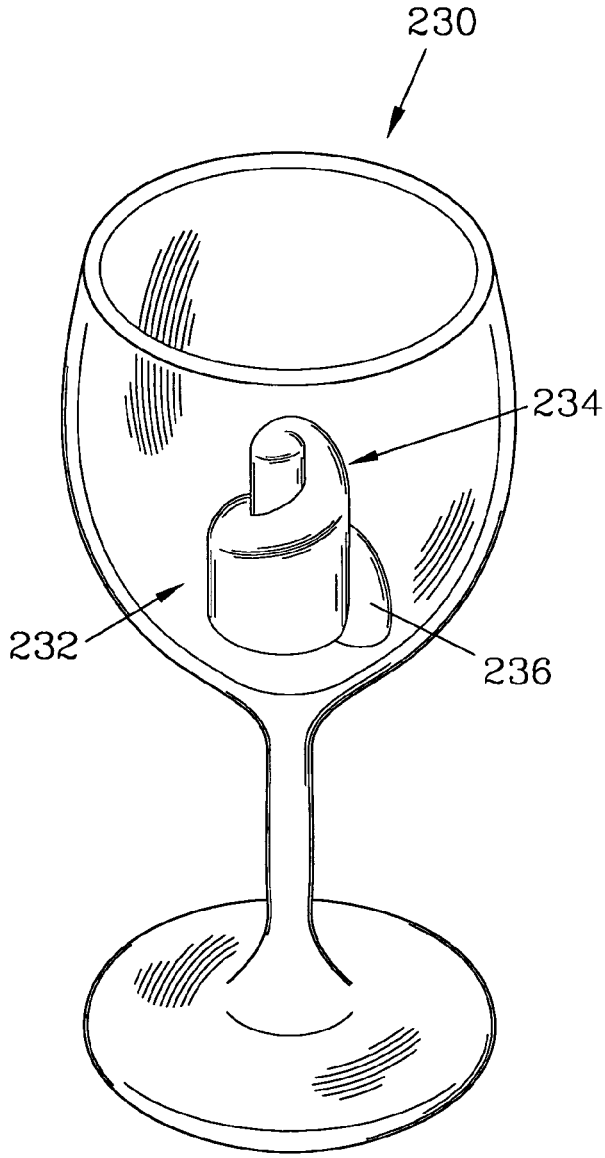
FIG. 6 illustrates an embodiment similar to that of FIGS. 3 and 5, but where the ramp has a wine-supporting ledge surface that is convex when viewed from above. This geometry should provide a more gentle fall for the wine, and thus less aeration.

FIG. 6 illustrates a wineglass 230 which has a protrusion 232 which is similar in many respects to the protrusion 112 shown in FIG. 3 and the protrusion 200 shown in FIG. 5. The protrusion 232 differs in that it has a spiral ramp 234 having a wine-supporting ledge surface 236 that is convex when viewed from above. The convex wine-supporting ledge surface 236 will provide more of a runoff action off the spiral ramp 234 than a cascading action as provided by the two embodiments which employ either substantially planar or concave surfaces. Thus, the protrusion 200 should give a more gentle action than the protrusions (112, 200) shown in FIGS. 3 and 5 for otherwise similar geometries.

Figure 7:
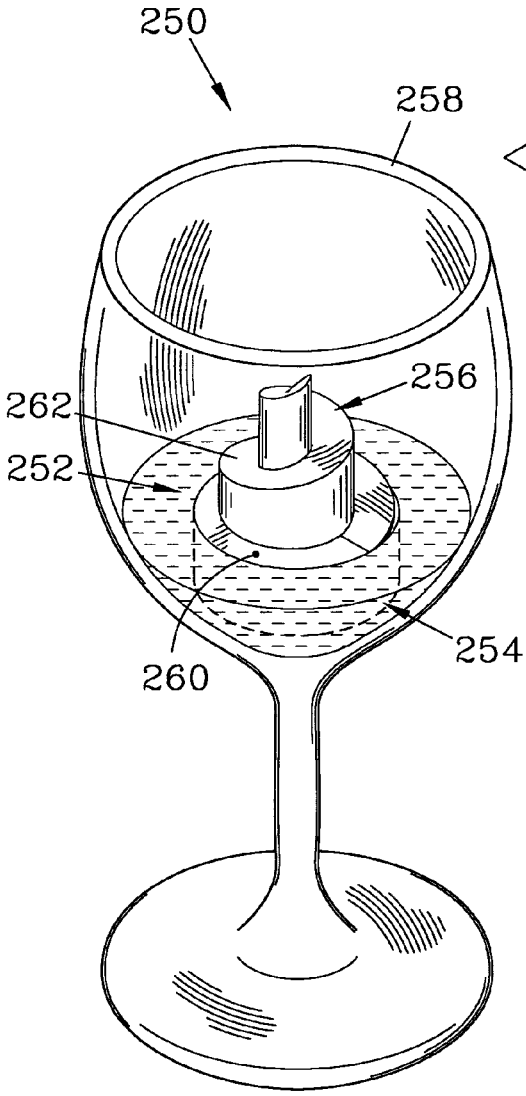
FIG. 7 is isometric view of another embodiment of the present invention, where the protrusion has a ramp portion which is similar to the protrusion illustrated in FIG. 3; however, the ramp portion of the protrusion is mounted on a pedestal. The pedestal provides an index to facilitate pouring a constant size sample of wine for tasting.

FIG. 7 is an isometric view of another embodiment, a wineglass 250 having a protrusion 252 which has a pedestal portion 254 and a ramped portion 256. The pedestal portion 254 is preferably cylindrical, and can serve as a measure of a small amount of wine to be sampled. The pedestal portion 254 is preferably sized relative to a bowl 258 of the wineglass 250 such that, when the bowl 258 is filled to a level even with a top surface 260 of the pedestal portion 254 as shown, the quantity of wine contained in the bowl 258 is an integer fraction of the standard volume of a wine bottle (the standard volume is typically either 750 ml or 1500 ml). The sample of wine can then be swirled, and will be raised up onto the ramped portion 256 which has a ramp surface 262 which is similar to the spiral ramp 120 shown in FIG. 3, but is comparatively vertically foreshortened.

Figure 8:
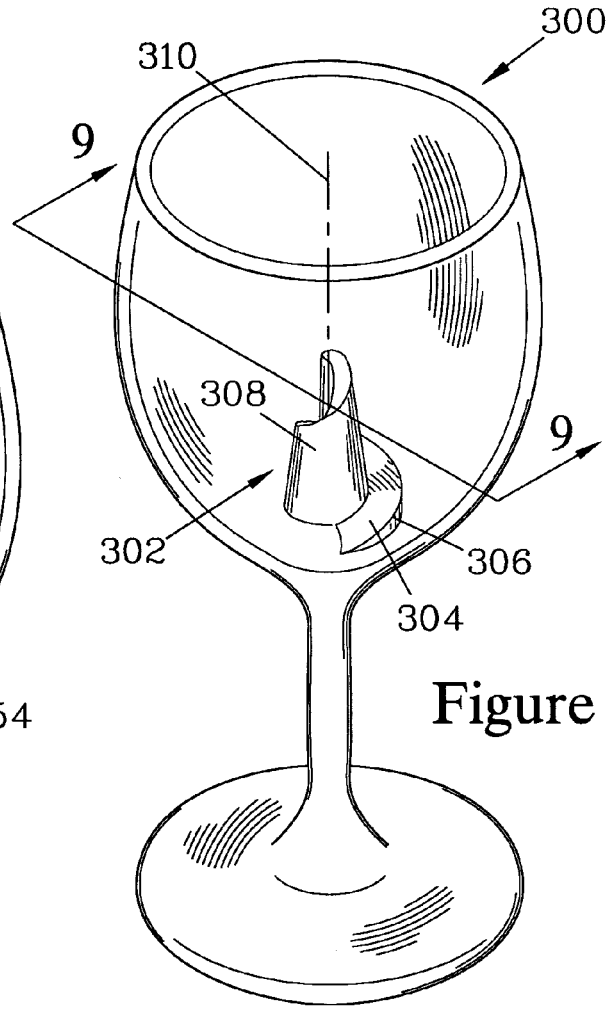
FIG. 8 illustrates another embodiment, where the protrusion has a non-vertical riser which is slanted towards the central axis, as well as a ledge extending from and winding around the central axis to form a spiral ramp that decreases in width as the elevation increases.
Figure 9:
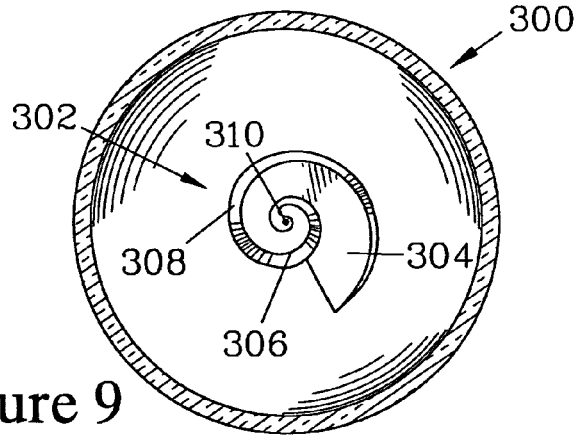
FIG. 9 is a view of the section 9-9 of FIG. 8, where the section is above the level of the protrusion, further illustrating the shape of the protrusion.

FIG. 8 is an isometric view of another embodiment of the present invention, a wineglass 300 having a protrusion 302 with a spiral ramp 304. The wineglass 300 is similar in many ways to the wine glass 150 shown in FIG. 4. The spiral ramp 304 has a peripheral edge 306 that, when viewed vertically as shown in the section view of FIG. 9, forms a logarithmic spiral. The wraps of the ramp surface 304 are separated by a riser 308 which is pitched towards a central axis 310 as its elevation increases.

All of the configurations discussed above are designed so that the surfaces of the protrusion could be formed by pressing hot glass into a mold to form the protrusion. Other configurations could also be constructed by glass blowing and drawing the protrusion up from the bottom.

Figure 11:
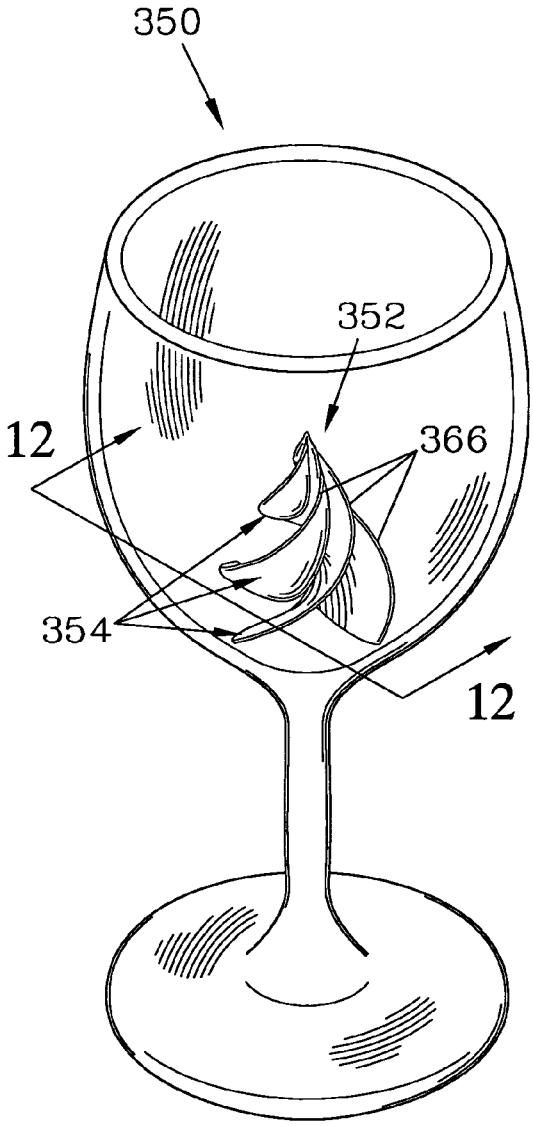
FIG. 11 illustrates another embodiment, where the protrusion includes multiple ramps which are intertwined. The ramps can be conceptually visualized by twisting the mast of the preform shown in FIG. 10 so that the sails twist to form four interpenetrating, non-intersecting spiral ramps.
Figure 10:
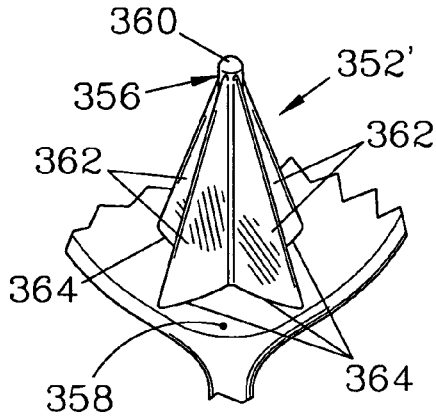
FIG. 10 is a precursor structure for the protrusion illustrated in FIGS. 11 and 12. This structure has a central core to which four substantially vertical triangular elements are attached. This structure can be viewed as being four orthogonal sails attached to a mast. These sails are also attached to the bottom region of the glass.
Figure 12:
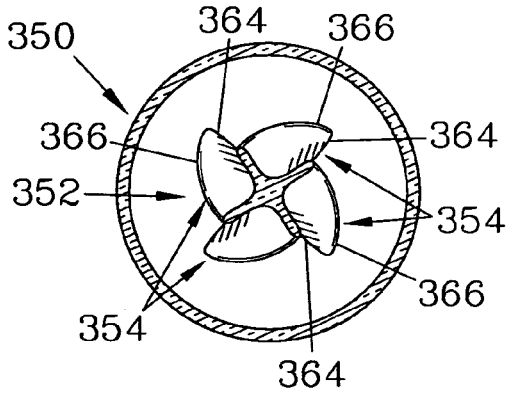
FIG. 12 is a view of the section 12-12 of FIG. 11, illustrating a cross section of the protrusion to show further details of its structure.

FIGS. 11 and 12 illustrate another embodiment, a wineglass 350 having a protrusion 352 which has four spiral ramps 354 that are intertwined in a non-intersecting manner, while FIG. 10 shows the precursor structure 352' which should be helpful in visualizing how the protrusion 352 may be formed. The precursor structure 352' forms a part of the wineglass 350 and has a central core 356 that is affixed to a base region 358 of the wineglass 350 (shown in FIG. 11) and terminates in a core free end 360. Four substantially vertical elements 362 are symmetrically and orthogonally disposed about the central core 356. These elements 362 are substantially triangular and attach to the central core 356, and can be viewed as sails attached to the central core 356, which serves as a mast. The substantially vertical elements 362 are also attached to the base region 358 of the wineglass 350 along lines of attachment 364, which can be viewed as booms securing the bottom edges of the sails.

The protrusion 352 can be formed from the precursor structure 352' by heating the glass above the softening point of the glass and twisting the central core 356 of the precursor structure 352' to stretch and wrap the substantially vertical elements 362 into the form illustrated in FIG. 11. As the central core 356 is twisted, the series of interpenetrating non-intersecting ramps 354 are created, as illustrated in FIGS. 11 and 12. This structure will provide the four ramps 354 which should lift the wine and spill it off of peripheral edges 366 of the ramps 354 as the wineglass 350 is swirled. This should provide a greater agitation of the wine for the same swirling conditions.

Figure 13:
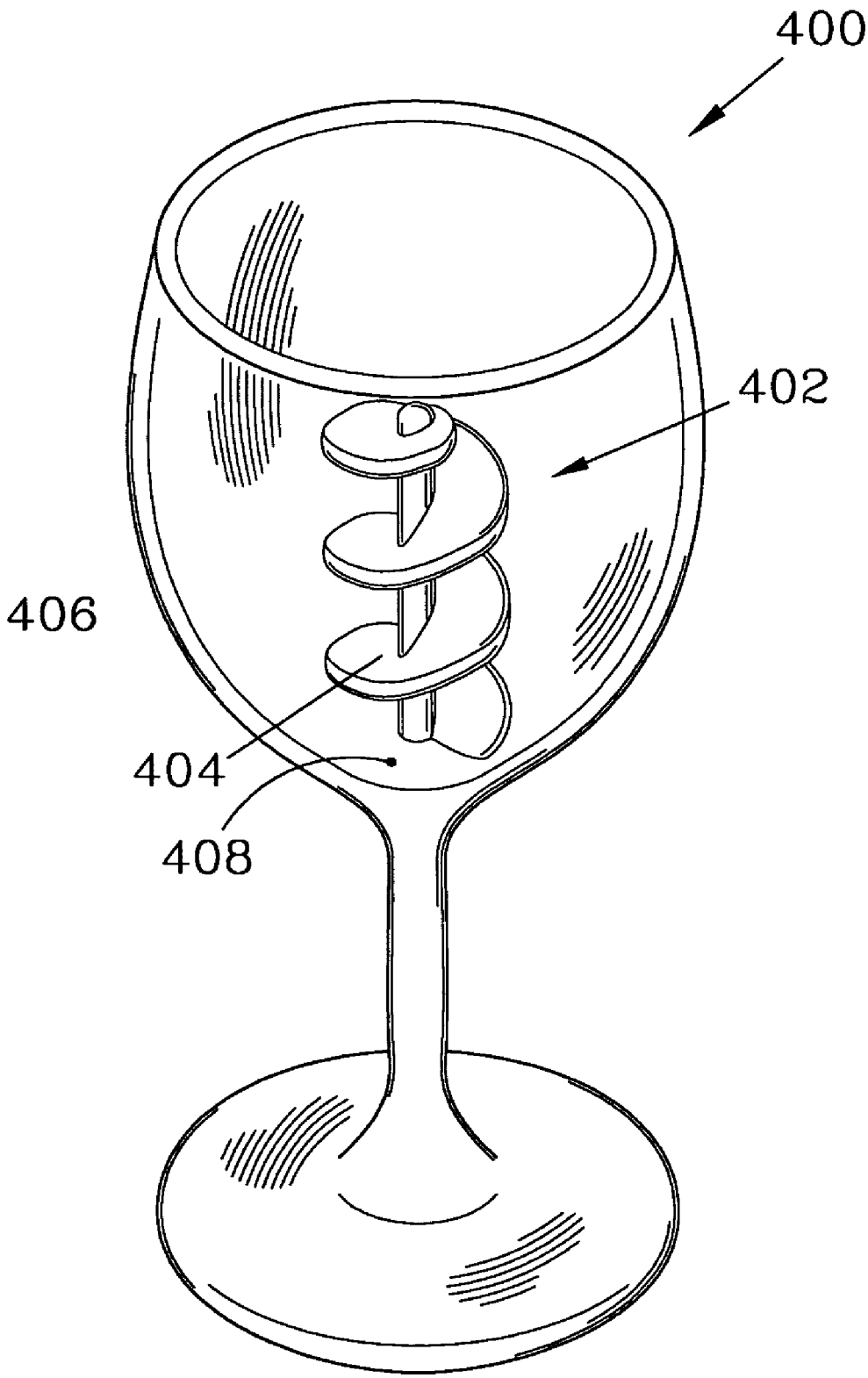
FIG. 13 is an isometric view of another embodiment of the present invention, where a spiral ramp of constant width is employed. This spiral ramp wraps about a cylindrical central core having a uniform cross section and provides a central protrusion that has a shape similar to a bit of a brace used to drill holes.

FIG. 13 is an isometric illustration of another embodiment, a wineglass 400 having a protrusion 402, which has a spiral ramp 404 which wraps around a cylindrical core 406 to form an auger-shaped protrusion. This configuration may have benefits in that it may provide some agitation; however, it will not result in the wine cascading from level to level. It would appear that its effectiveness may be a function of the pitch of the ramp 404. Also, this structure may be subject to breakage, since it has only minimal attachment to a bottom region 408 of the wineglass 400. The protrusion 402 may also be difficult to clean due to the undercut surfaces.

While the novel features of the present invention have been described in terms of particular embodiments and preferred applications, it should be appreciated by one skilled in the art that substitution of materials and modification of details obviously can be made without departing from the spirit of the invention.

What I claim is:

1. A wineglass comprising:

bowl with a central axis and a bottom region symmetrically disposed thereabout; and a protrusion having, a central core which attaches to said bottom region of said bowl and extends along said central axis up into said bowl, said central core terminating in a core free end, and a ledge attached to said central core and positioned such that at least a portion of said ledge is configured so as to provide a wine-supporting ledge surface that is intermediate between said central core free end and said bottom region of said bowl, wherein said ledge forms a single spiral ramp which encircles said central axis, said single spiral ramp extending between peripheral edge and a downward-directed riser, said peripheral edge generally decreasing in radius from the central axis as said single spiral ramp rises above the bottom region of the bowl, and said riser having a riser depth d extending downward from said peripheral edge to terminate at another wrap of said spiral ramp so as to form a backed step.

2. The wineglass of claim 1 wherein said single spiral ramp has a width W which decreases as said spiral ramp rises above said bottom region of said bowl.

3. The wineglass of claim 2 wherein said riser depth d of said downward directed riser decreases as the elevation of said single spiral ramp increases.

4. The wineglass of claim 3 wherein the variations in d and W are exponential (logarithmic) with distance from said bottom region.

5. The wineglass of claim 3 wherein said single spiral ramp has a concave surface when viewed from above the wineglass.

6. The wineglass of claim 3 wherein said single spiral ramp has a convex surface when viewed from above the wineglass.

7. The wineglass of claim 1 further comprising:

a base connected to said bowl so as to provide a flat surface for supporting said bowl upright on a horizontal surface.

8. The wineglass of claim 7 further comprising:

a stem interposed between said base and said bowl.

9. The wineglass of claim 1 wherein said spiral ramp resides atop a pedestal portion, which is interposed between said bottom region of said bowl and said spiral ramp.

* * * * *